US005732419A

United States Patent [19]

Feist

[11] Patent Number: 5,732,419

[45] Date of Patent: Mar. 31, 1998

[54] RETRACTABLE SHOWER SCREEN

[75] Inventor: Patrick Feist, Kelowna, Canada

[73] Assignee: Voltiguer Holdings Ltd., Kelowna, Canada

[21] Appl. No.: 666,399

[22] PCT Filed: Dec. 6, 1994

[86] PCT No.: PCT/CA94/00670

§ 371 Date: Aug. 15, 1996

§ 102(e) Date: Aug. 15, 1996

[87] PCT Pub. No.: WO95/15709

PCT Pub. Date: Jun. 15, 1995

[30] Foreign Application Priority Data

Dec. 6, 1993 [CA] Canada ..... 2110824

[51] Int. Cl.[6] ..... A47K 3/08

[52] U.S. Cl. ..... 4/558; 4/557; 4/607; 4/608; 4/610

[58] Field of Search ..... 4/558, 557, 607, 4/608, 610; 160/133, 245, 243, 238, 266, 291, 296

[56] References Cited

U.S. PATENT DOCUMENTS

| | | | |
|---|---|---|---|
| D. 334,682 | 4/1993 | Weeks | D6/575 |
| 2,509,398 | 5/1950 | Peremi et al. . | |
| 2,840,827 | 7/1958 | Calvano | 4/558 |
| 3,965,960 | 6/1976 | Massey | 160/295 |
| 4,122,559 | 10/1978 | Kelly | 4/149 |
| 4,286,343 | 9/1981 | Lampka | 4/596 |
| 4,777,673 | 10/1988 | Patteson et al. | 4/558 |
| 4,916,764 | 4/1990 | Meaden et al. | 4/558 |
| 5,033,132 | 7/1991 | Greenblatt | 4/558 |
| 5,231,708 | 8/1993 | Hansen | 4/608 |
| 5,332,021 | 7/1994 | Todd et al. | 160/133 |
| 5,333,664 | 8/1994 | Sirianni et al. | 160/23.1 |

FOREIGN PATENT DOCUMENTS

| | | |
|---|---|---|
| 92 14 429.2 | 4/1993 | Germany . |
| 93 04 750.9 | 7/1993 | Germany . |

*Primary Examiner*—David J. Walczak
*Attorney, Agent, or Firm*—Antony C. Edwards

[57] ABSTRACT

A retractable shower screen has a spring-biased roller with first and second ends; first and second brackets, mountable to opposed walls in a shower stall, for releasable respective mating engagement with the first and second ends of the roller; a flexible sheet having first and second longitudinal edges, the first longitudinal edge of the flexible sheet releasably attachable to the roller between the first and second ends; a sealing bar, releasably attachable to the second longitudinal edge of the second flexible sheet, for sealing the longitudinal edge of the flexible sheet to the shower stall; the spring-biased roller having a spring for rotating the roller, whereby the flexible sheet may be rolled onto and unrolled from the roller; a ratchet co-operating with the roller, the ratchet releasably engageable whereby, when engaged, the flexible sheet may only be unrolled from the roller, the engaged ratchet preventing retraction of the flexible sheets onto the roller; whereby when the ratchet is engaged the flexible sheet may be unrolled from the roller the flexible sheet then detachable from the roller.

24 Claims, 19 Drawing Sheets

RETRACTABLE SHOWER SCREEN

FIELD OF THE INVENTION

The invention relates to the field of retractable shower screens and in particular shower screens of the type comprising a screen retractably mounted on a roller housed in an elongate casing.

BACKGROUND OF THE INVENTION

U.S. Pat. No. 4,122,559 which issued Oct. 31, 1978 to David Kelly for "Shower Screen" describes a shower screen unit having a horizontal roller shaft to which an end region of an elongate sheet of material is attached. The roller shaft is supported in a substantially horizontal position above the edge of a bath, for example, and is rotatable about its' longitudinal axis so that the elongate sheet of material can be rolled up on the roller shaft: when not in use, or unrolled from the roller shaft to close off the shower area. Kelly teaches a further element in combination comprising at least one freely rotatable water-absorbent roller, parallel to the roller shaft, the absorbent roller pressing against the screen material so as to absorb water from the screen material as the screen material is rolled up on the roller shaft. Kelly also discloses that the roller screen operates in an identical manner to a retractable window blind or alternatively that the roller shaft may be connected to an electric motor to roll up or unroll the screen.

Meaden, U.S. Pat. No. 4,916,764, which issued Apr. 17, 1990 for a Bathtub Shower Curtain Assembly, also teaches a retractable shower curtain. Meaden differs from Kelly in that the shower curtain retracts horizontally.

Massey, U.S. Pat. No. 3,965,960, which issued Jun. 29, 1976, for a Retractable Shower Shade with Adjustable Extensibility, discloses a shower roller-blind shade which retracts onto and depends from a roller for adjustably limited extension. The mountings for the roller are combined with a housing which carries a wiper for stripping water from the inside wetted surface of the shade when the shade is extended or retracted. Opposed end plates act as anchors to anchor the housing and roller to a shower stall. As the shade is extended, a nut is rotated on an elongate feed screw within the roller. The nut rotates along the feed screw until its travel is ended against a stop at which point the roller can be rotated no further, the extension of the shade being thereby limited. A releasable latch engages the nut once the nut reaches the stop. A pull rod releases the latch to allow the spring biased roller to retract the shade into the housing.

This invention relates to shower screen units of which the Kelly, Meaden and Massey devices are examples. It is an object of this invention to provide an improvement in the means by which the shower screen material, that is, the elongate sheet, may be attached to the roller shaft and the means for controlling the rolling and unrolling of the screen from the roller shaft.

It is a further object of the present invention to provide an improved roller shower screen unit in which the shower screen material is guided vertically within wall tracks or rails and the shower curtain material has along its' lowermost edge a seal bar for mating with the edge of a bathtub or shower stall basin, the ends of the seal bar releasably engageable with the base of the wall tracks so as to inhibit the egress of water from the tub or shower stall.

It is a further object of the invention to provide a ratchet mechanism for controlled unrolling of the shower screen from the roller shaft, so as to facilitate locking the shower screen in the unrolled position so that the screen may be removed from the roller shaft for cleaning.

SUMMARY OF THE INVENTION

The retractable shower screen of the present invention has a spring-biased roller having first and second ends, the ends of the roller fitting into first and second brackets mounted to opposed walls in a shower stall. The roller ends releasably mate with the first and second brackets. A first sheet of flexible material having first and second longitudinal edges may be provided so that the first longitudinal edge of the first flexible sheet may be releasably attached to the roller between the ends of the roller. A second flexible sheet, the shower screen, having first and second longitudinal edges, is provided so that the first longitudinal edge of the second flexible sheet may be releasably attached to the second longitudinal edge of the first flexible sheet or directly to the roller if a first flexible sheet is not incorporated. A sealing means is provided, releasably attachable to the second longitudinal edge of the second flexible sheet, for sealing the second longitudinal edge of the second flexible sheet to the sill of the shower stall basin.

The spring-biased roller has conventional spring biasing means for rotating the roller, whereby the first and second flexible sheets, when attached, may be consecutively rolled onto and unrolled from the roller.

A ratchet is provided, mountable between the first bracket and the first end of the roller. The ratchet may have a releasably engageable toothed gear and dog mechanism which co-operates with the roller to prevent retraction of the flexible sheet or sheets onto the roller when the ratchet is engaged. The ratchet maybe engaged by pivotally engaging the dog with the toothed gear. When the ratchet is engaged the second flexible sheet may be unrolled from the roller so as to extend the second flexible sheet from the housing thereby exposing the first longitudinal edge of the second flexible sheet, and also exposing the second longitudinal edge of the first flexible sheet if incorporated, whereby the second flexible sheet may be detached from the first flexible sheet or from the roller for cleaning.

DETAILED DESCRIPTION OF PREFERRED EMBODIMENTS

Figure 1:
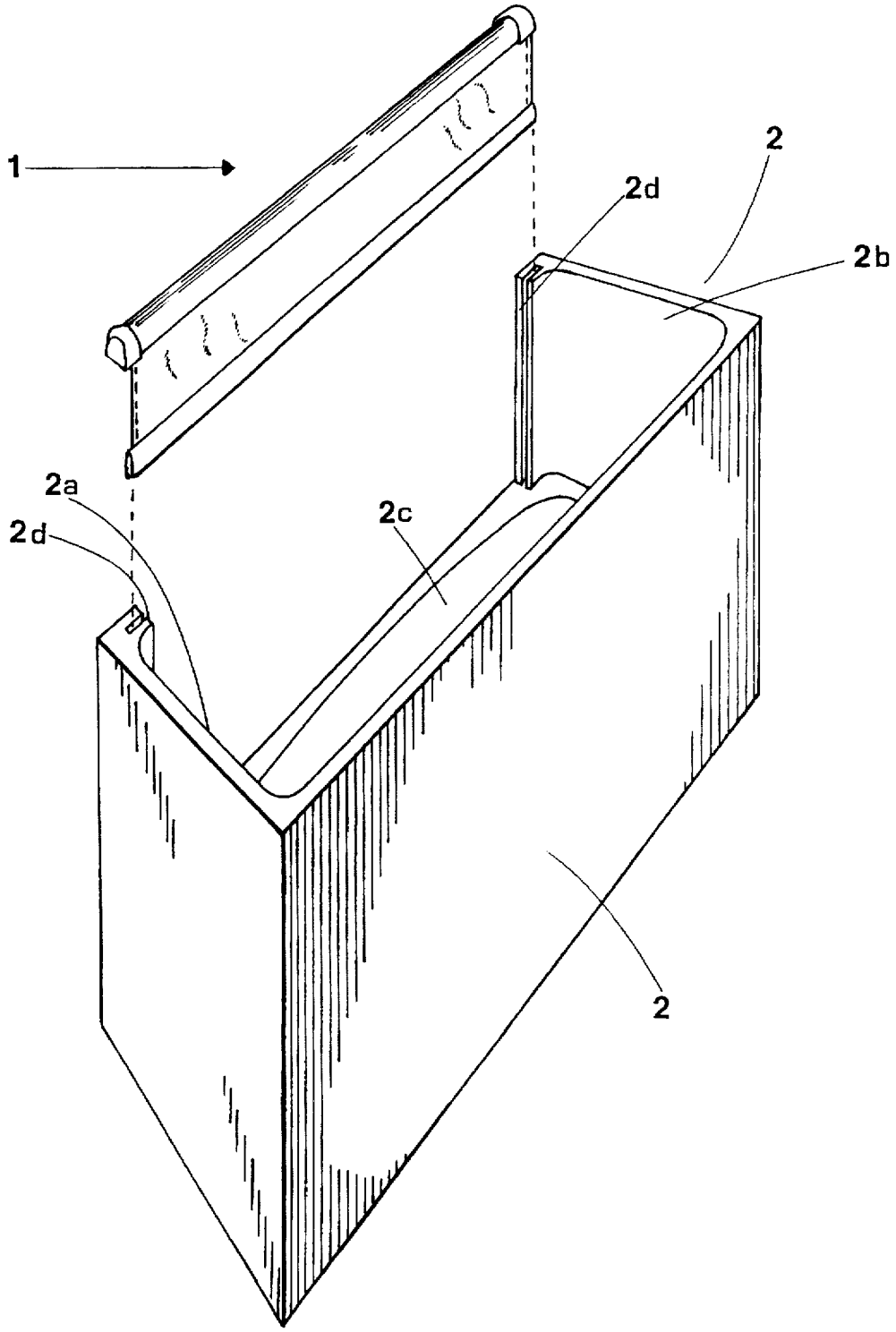
FIG. 1 is, in exploded perspective view, a shower stall and the retractable shower screen of the present invention.

FIG. 1 illustrates how retractable shower screen 1 of the present invention cooperates with a shower stall 2. Shower stall 2 has opposed facing side walls 2*a* and 2*b* and a catch basin 2*c*. The side walls and the catch basin define a front opening which is used for access to the shower enclosure. Retractable shower screen 1 is mounted between side walls 2*a* and 2*b* and in the embodiment illustrated in FIG. 1 is clipped onto opposed facing moulded rails 2*d*.

Figure 2:
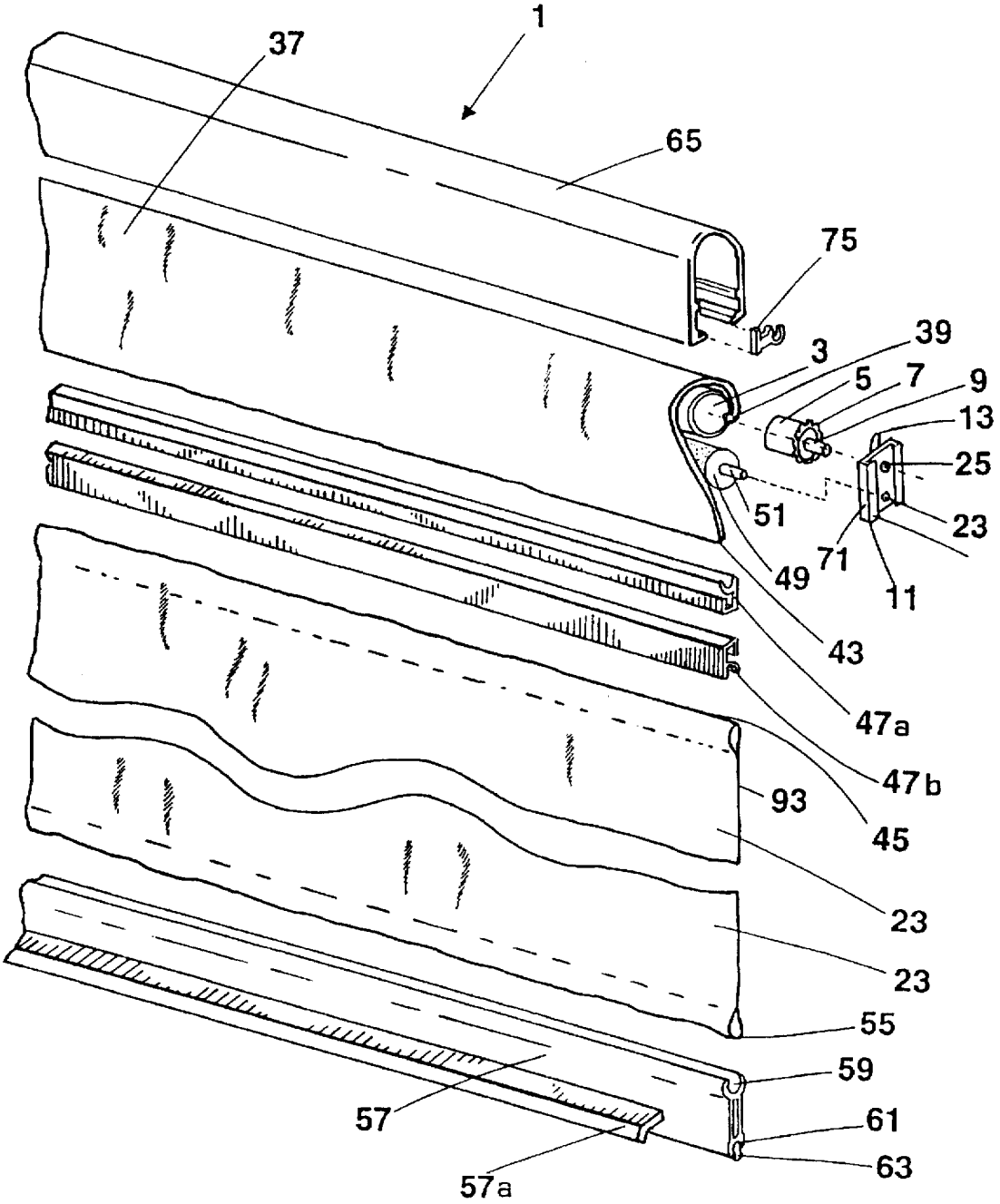
FIG. 2 is an exploded perspective partial cut-away view of a preferred embodiment of the retractable shower screen of the present invention.
Figure 17A:
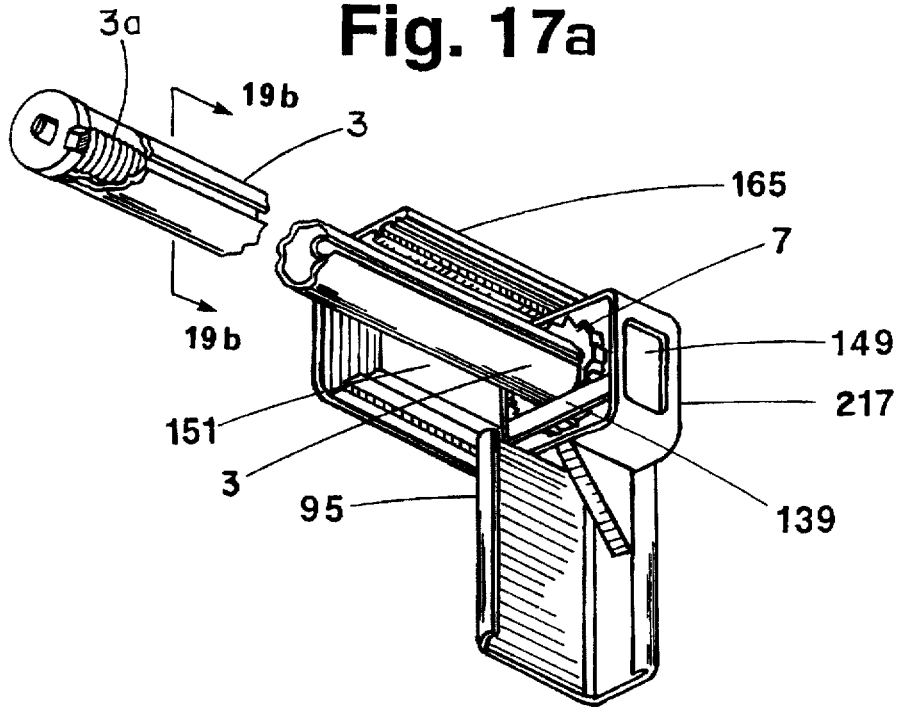
FIGS. 17*a* and 17*b* are perspective cutaway views of the roller housing, roller and ratchet mechanism of the retractable shower screen of the present invention.

As illustrated in FIG. 2, in a preferred embodiment retractable shower screen 1 has spring-biased retractable roller shall 3 in which, at one end, is fixedly mounted end cap 5. Spring-biased retractable roller shaft 3 may be of a conventional design incorporating at one end (conveniently the end opposed to the end of roller 3 mounted onto end cap 5) a conventional roller-blind spring assembly such as that manufactured by Stewart Hartshorn, a division of Cooper Industries, Sturgis, Mich., U.S.A. incorporating the biasing spring 3*a* seen in FIG. 17*a*. End cap 5 has gear teeth 7 and axle 9 so that when fixedly mounted in roller shaft 3, gear teeth 7 extend radially outward from around the rim of the roller shaft, and axle 9 extends from the roller shaft along the roller shaft longitudinal axis. Ratchet housing 11, illustrated in exploded detail in FIG. 3, supports ratchet lever 13 pivotally mounted within housing 11 above end cap receiving cavity 15 (see FIGS. 3, 4).

Figure 5:
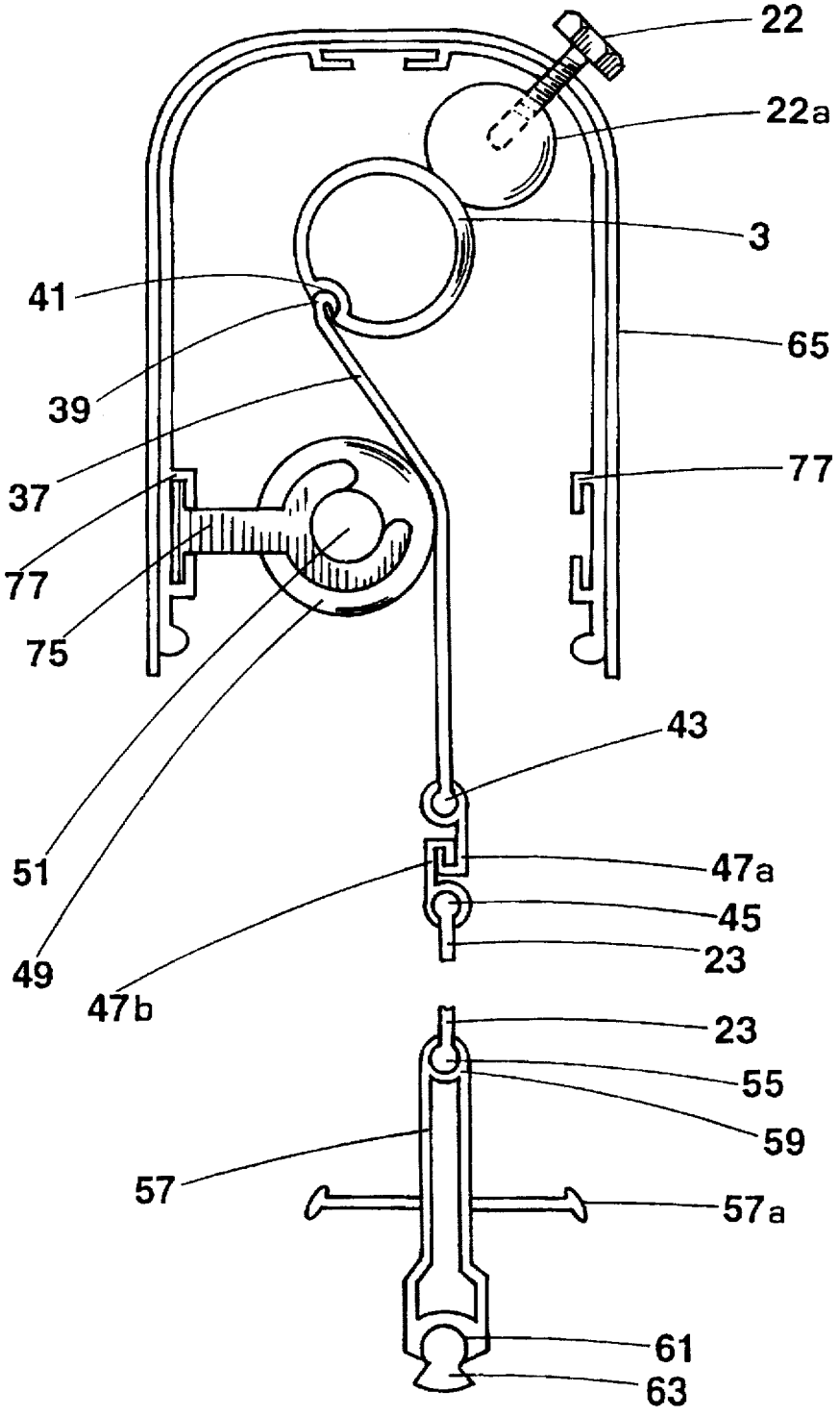
FIG. 5 is an end-on side elevation view of the assembled retractable shower screen of FIG. 2.

As also illustrated in FIG. 2, a strip of flexible material, referred to as a first flexible sheet or alternatively as screen extension 37, is attached to roller shaft 3 along a first longitudinal edge 39 of screen extension 37. The other longitudinal edge of screen extension 37, longitudinal edge 43, is attached to the top edge of shower screen 23. In particular, longitudinal edge 39 of shower screen extension 37 slidingly mates in groove 41 (see FIG. 5). Groove 41 is a longitudinal groove in roller shaft 3 as best seen in FIG. 5. Longitudinal edge 39 fits snugly into groove 41. As may be seen, longitudinal edge 39 may comprise a flexible rod or the like which is attached to longitudinal edge 39 or fitted into a sleeve formed in longitudinal edge 39.

Shower screen extension 37 has lower longitudinal edge 43. Lower edge 43 may be releasably attachable to upper edge 45 of shower screen 23 either by Velcro™ or like releasable fasteners, or, in the preferred embodiment illustrated, by means of coupling rails 47*a* and 47*b*. Upper coupling rail 47A is attached to lower edge 43 and, as illustrated in FIG. 5, may be attached by a sliding fitment. That is, lower edge 43 may slidingly mate in an upper groove in upper coupling rail 47A.

Corresponding lower coupling rail 47B may similarly be attached to upper screen edge 45 (see FIG. 5) so that screen 23 may be releasably attached to screen extension 37 by hooking coupling rails 47*a* and 47*b* together as depicted in FIG. 5.

As also illustrated in FIG. 2, sponge roller 49 rotates freely about axle 51 journalled in axle mount 53 in ratchet housing 11.

Screen 23 has lower edge 55. As seen in FIGS. 2 and 5, seal bar 57 may be slidingly mated or friction fitted (for example in the manner of a ZIPLOCK (TM) releasable closure) onto lower screen edge 55, lower screen edge 55 again being a sliding male fit in upper groove 59 on seal bar 57 In FIG. 5, screen 23 is shown fragmented, that is not shown in true relative size. A lower groove 61 on seal bar 57 supports seal 63 in a sliding fit. Seal 63 may be a resilient rubber or like material. Seal bar 57 also incorporates flanges 57*a* which act to cascade water away from seal 63 and also provide a handle which may be gripped when lowering seal bar 57 and screen 23. Typically, flanges 57*a* are notched or otherwise cut-away at the ends of seal bar 57 to enable the ends of seal bar 57 to travel vertically in wall tracks 95 (see FIG. 8). Alternative embodiments of seal bar 57 namely , seal bars 157, 257, 357, 457 and 557 are illustrated in FIGS. 7, 13, 20, 21 and 22 respectively.

Figure 12:
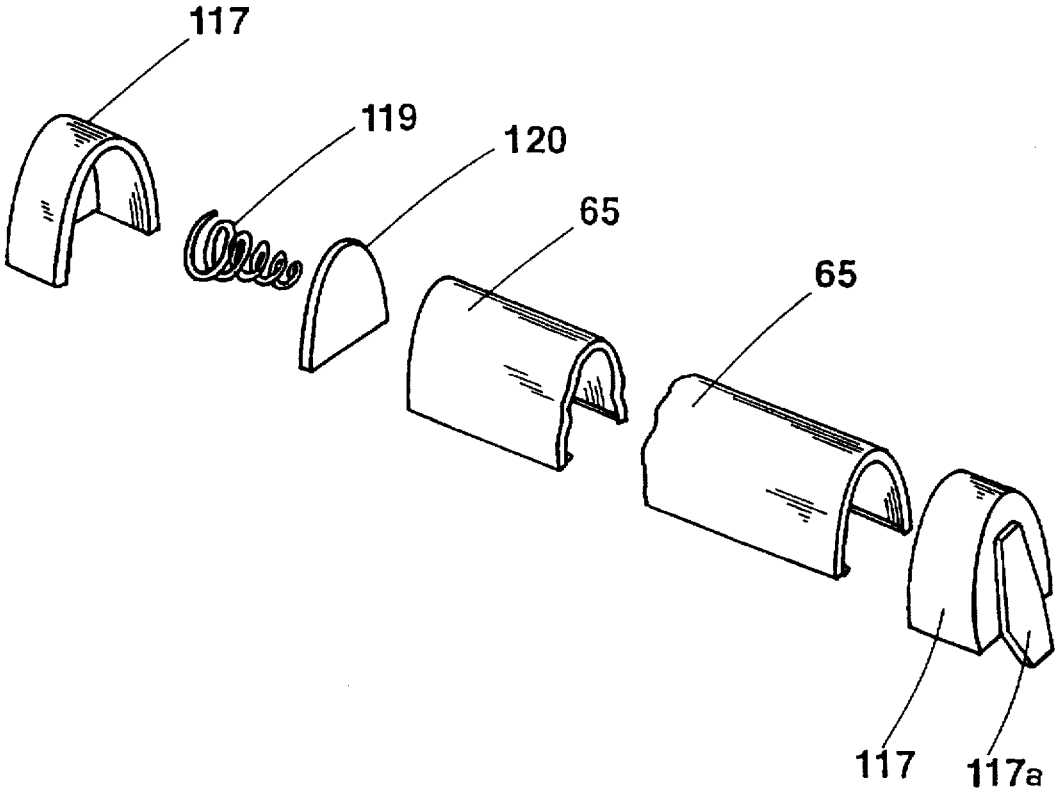
FIG. 12 is, in perspective view, an alternative embodiment of a wall mounting attachment.
Figure 14:
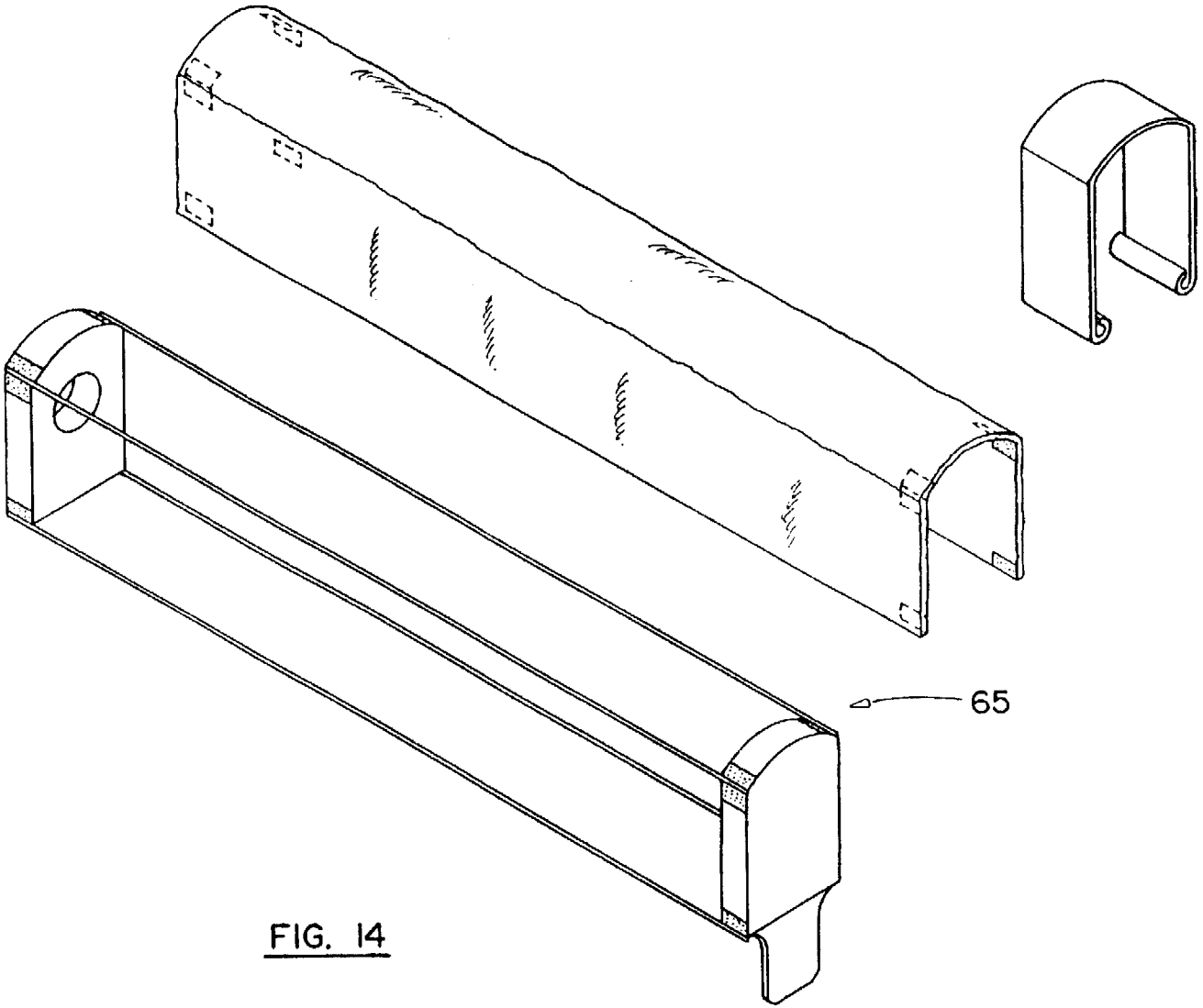
FIG. 14 is, in exploded perspective view, an alternative embodiment of the roller housing of the present invention.
Figure 17B:
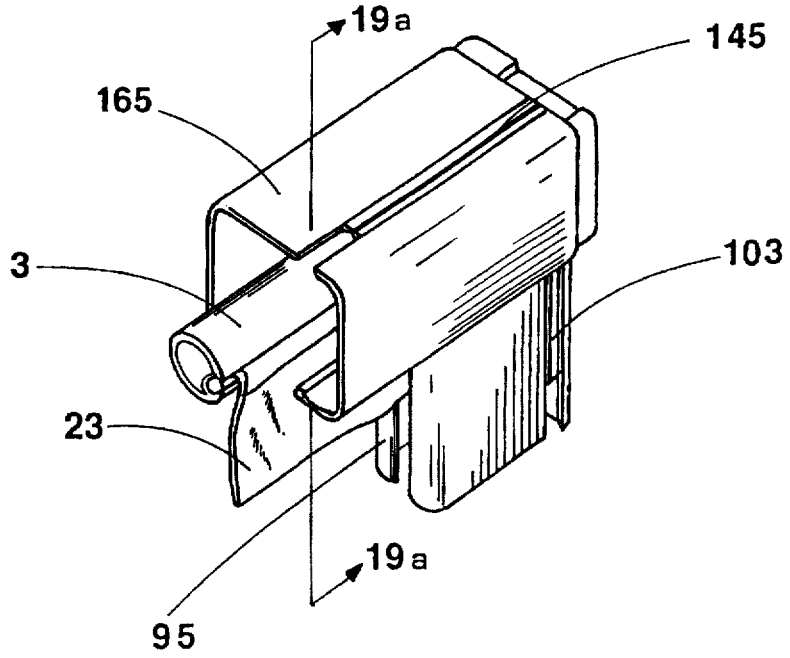
Figure 18:
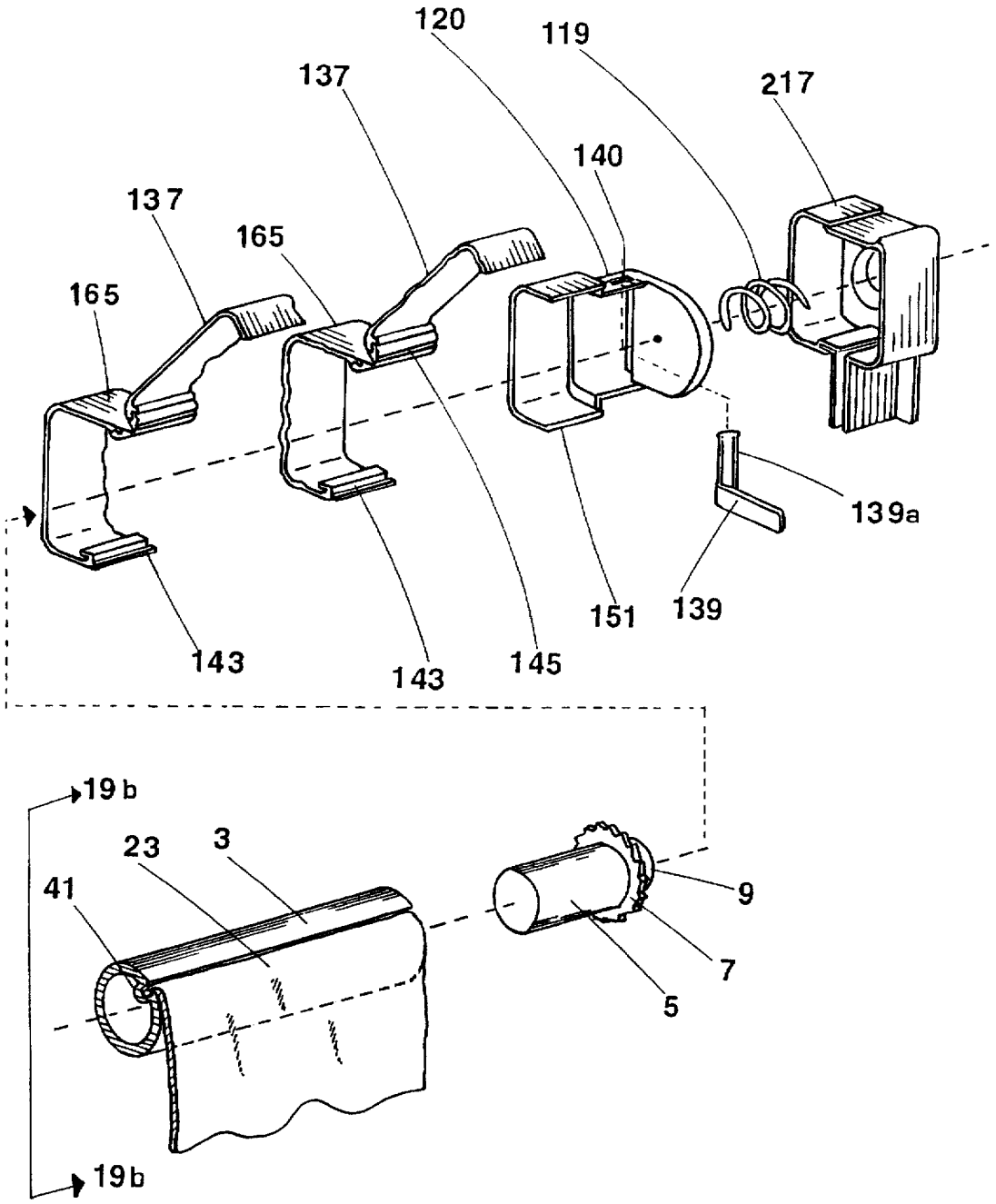
FIG. 18 is an exploded view of FIG. 17*b*.

Roller housing 65 may provide an aesthetic cover for roller shaft 3, screen extension 37 and sponge roller 49. Housing 65 may, for example, be of plastic (see for example FIG. 2) or fabric (see FIG. 14) and may snugly fit over the outside contours of ratchet housing 11 or otherwise attach to ratchet housing 11. Alternatively ratchet housing 11 may snugly fit within housing 65, thus requiting that housing 65 be attachable either directly to the shower stall side walls 2*a* and 2*b*, or to side wall mounting brackets such as side wall mounting brackets 67 depicted in FIG. 6. Side wall mounting brackets 67 may be mounted to shower stall side walls 2*a* and 2*b* by screws or like fasteners (not shown) journalled in screw holes 69. Alternatively, as depicted in FIGS. 12 and 18, retractable shower screen 1 may be supported between opposed facing shower stall walls 2*a* and 2*b* by spring-biased mounting caps 117. Mounting caps 117 or, in an alternative embodiment, mounting caps 217, fit over the ends of roller housing 65 or, respectively, in an alternative embodiment, over the ends of roller housing 165 and are biased away from the ends of roller housing 65 or, respectively, roller housing 165 by springs 119 which act against bearing plates 120 to force the mounting caps or at least one of the mounting caps against shower stall side wall thereby fictionally holding retractable shower screen 1 in place. The mounting caps may have removable mounting tabs, such as mounting tabs 117*a* which may be removed from mounting caps 117 ,which may be left permanently affixed either to, or partially behind, wall tracks 95. Tabs 117*a* mate in a sliding fit with mounting caps 117. As depicted in FIG. 17, the mounting caps 117 may have access window 149 through which a user may access the ratchet mechanism if it is desired to manually manipulate the ratchet when lowering or raising screen 23, also, for example, when adjusting tension. This allows for adjustments without having to take down retractable shower screen 1.

Figure 19A:
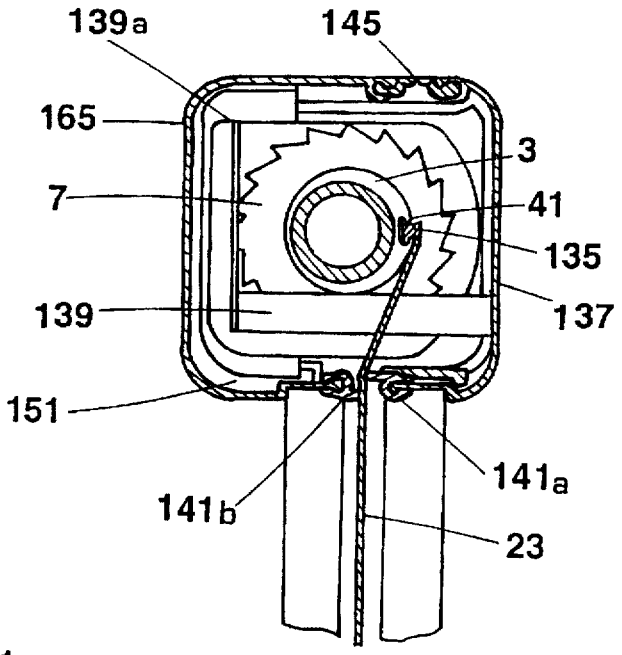
FIGS. 19*a* is a cross-sectional view along line 19*a*—19*a* in FIG. 17*b*.
Figure 19B:
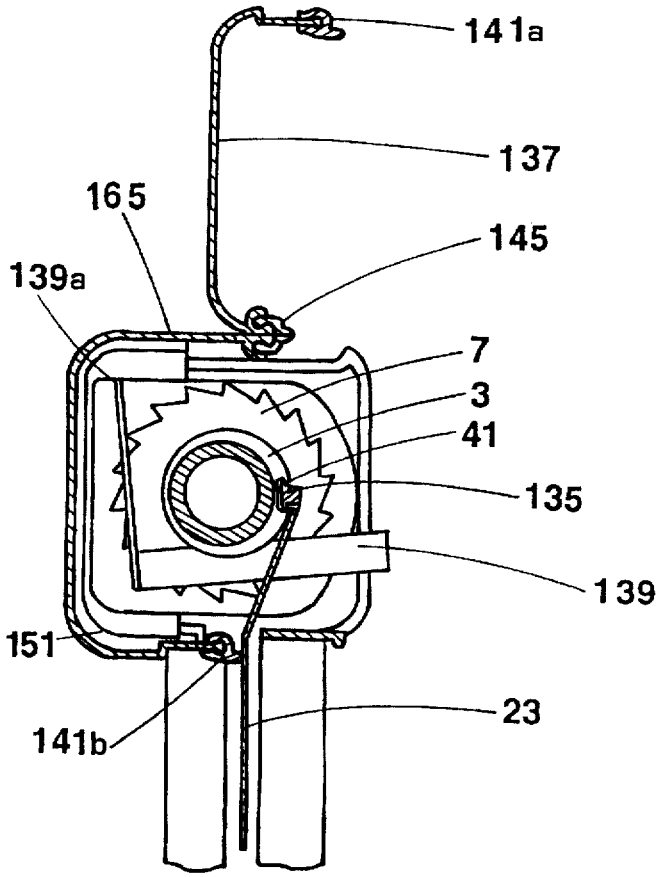
FIG. 19*b* is a cross-sectional view along line 19*b*—19*b* in FIGS. 17*a* and 18, that is, the cross-sectional view of FIG. 19*a* with the roller housing door open.

Within roller housing 65, as depicted in FIG. 5, stabilizing brackets 75 may be provided for supporting sponge rollers 49 or, alternatively, wipers (see FIGS. 19*a* and 19*b* at 141*a* and 141*b*). Brackets 75 are mounted into slots 77.

Figure 3:
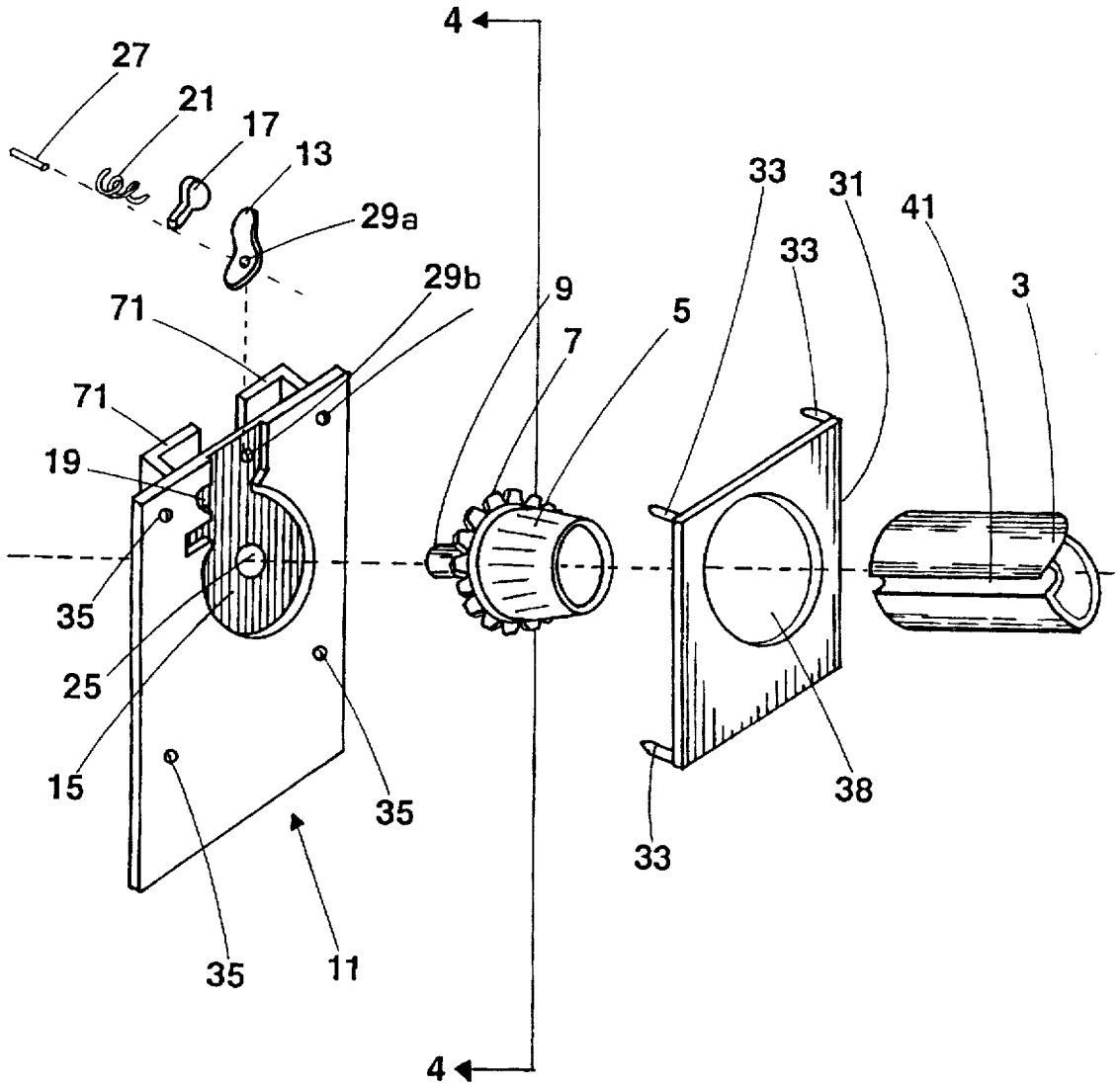
FIG. 3 is an exploded perspective partial cut-away view of the ratchet mechanism of FIG. 2.
Figure 4:
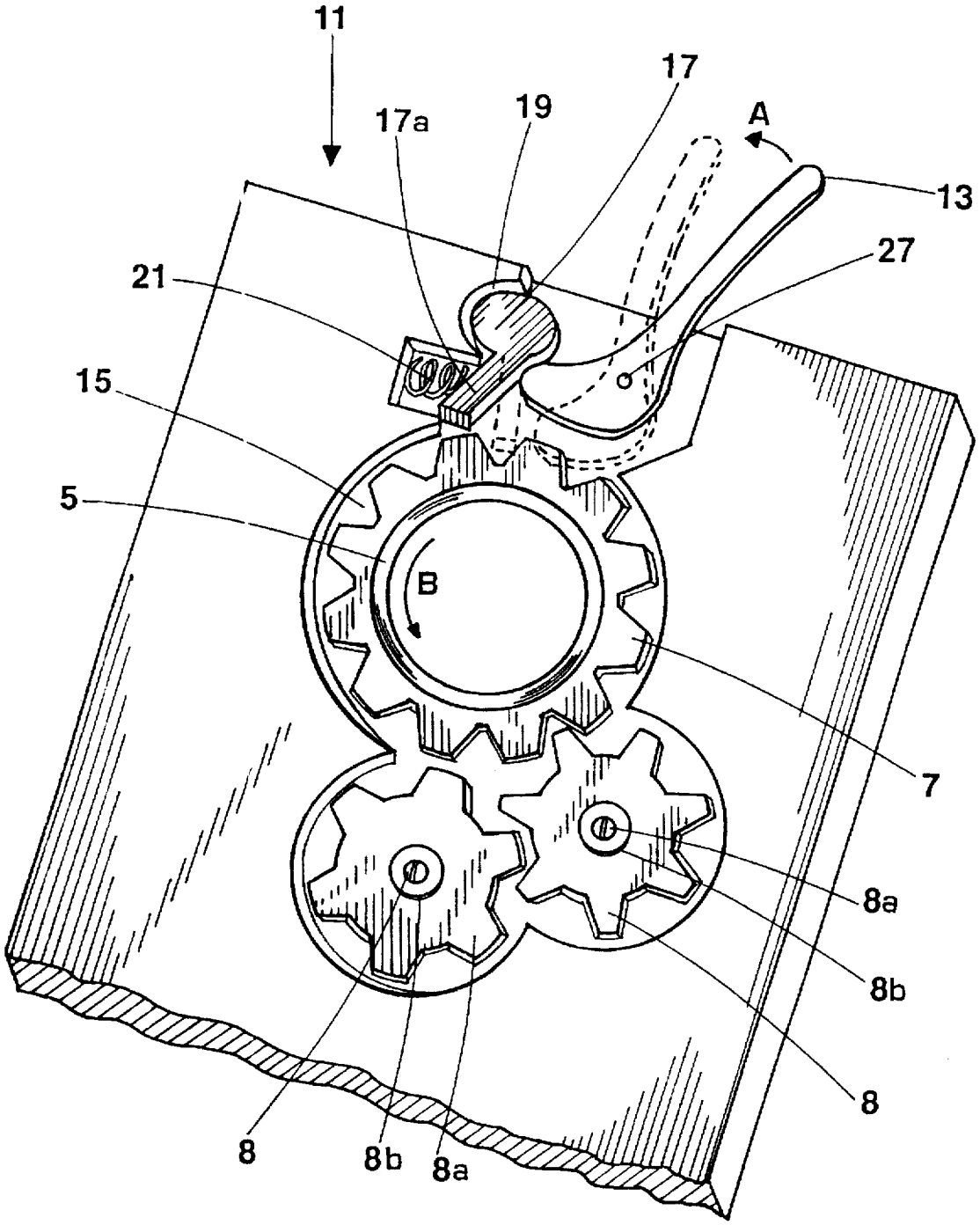
FIG. 4 is a perspective cut-away view along line 4—4 in FIG. 3 of our alternative embodiment of the ratchet mechanism of FIG. 3.

As illustrated in FIGS. 3 and 4, ratchet dog 17 is pivotally mounted within housing 11, more specifically within ratchet dog cup 19, so as to be rotatable within cup 19 against the returning spring biasing force or spring 21. End cap axle 9 is journalled in axle mount 25. Ratchet lever 13 is pivoted about pin 27 journalled in pin receiving holes 29*a* and 29*b*.

End cap 5, and therefore also roller shaft 3, are free to rotate in the manner of prior art retractable blinds when ratchet lever 13 is rotated so as to disengage dog 17 from teeth 7. Ratchet lever 13 forces dog 17 to rotate within cup 19 forcing gear engaging arm 17*a* against spring 21 thereby compressing spring 21.

When it is desired to engage the ratchet mechanism to control the unrolling of shower curtain 23 from roller shaft 3, ratchet lever 13 is moved in direction A thereby allowing dog 17 to be forced by spring 21 into engagement with gear teeth 7. With gear engaging arm 17*a* engaging gear teeth 7, end cap 5, and thereby roller shaft 3, can only be rotated in direction B, which coincides with rotating roller shaft 3 so as to unroll shower screen 23 from its' rolled up position on roller shaft 3.

As illustrated in FIG. 3, end cap 5 is held in place within end cap receiving cavity 15 by face plate 31. Face plate 31 has protrusions 33 which friction fit into holes 35 in housing 11 for mounting face plate 31 onto housing 11. Face plate 31 also acts to hold ratchet lever 13, ratchet dog 17, and spring 21 within their respective cavities within housing 11. Roller shaft 3 fits snugly within hole 38 in face plate 31. Roller shaft 3 is a tube which fits onto end cap 5 as end cap 5 protrudes from face plate 31 when face plate 31 is mounted onto housing 11.

FIG. 4 is a cut away view, along line 4—4 in FIG. 3 showing, in addition, an alternative embodiment wherein friction gears 8 are driven off gear teeth 7 on end cap 5. Friction gears 8 rotate about screws 8*a* which are secured to housing 11. Screws 8*a* may bear against washers 8*b*. Screws 8*a* may be tightened thereby increasing the frictional resistance to the rotation of gears 8. Friction gears 8, with screws 8*a* tightened, act as a braking mechanism to slow the rotation of end cap 5. Slowing the rotation of end cap 5 regulates the speed with which screen extension 37 and screen 23 is retracted and rolled up onto roller 3.

A further or alternative fiction mechanism for slowing the speed with which shower screen extension 37 and shower screen 23 are retracted onto roller 3 is depicted in FIG. 5. Threaded bolt 22 is journalled in housing 65 so that rotating bolt 22 moves resilient ball 22*a* towards roller 3. When resilient ball 22*a* is brought into contact with roller 3, the frictional engagement between resilient ball 22*a* and roller 3 acts as a brake on the rotation of roller 3. Resilient ball 22*a* could also be a resilient longitudinal roller along the length of roller 3. A further means of frictional braking is to constrain the ends of the seal bar, such as seal bar 57, snugly within wall tracks 95, the friction between the seal bar and wall tracks 95 providing the frictional braking. It is understood that the function of the frictional braking mechanism, whether friction gears 8 or resilient ball 22*a*, is the controlled retraction of screen 23 onto roller 3 when seal bar 57 is released from engagement with the sill of catch basin 2*c*.

Figure 6:
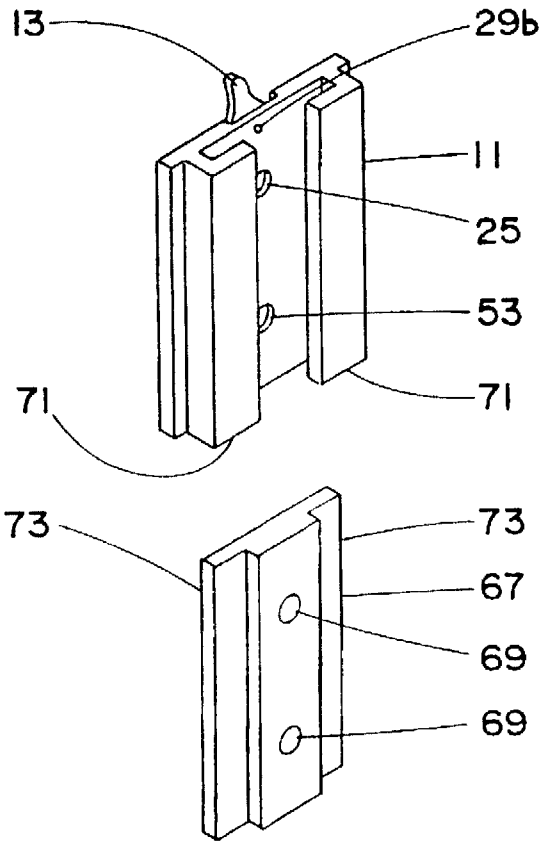
FIG. 6 is, in perspective view, a ratchet mounting attachment.

Illustrated in FIG. 6 is a view of the back of ratchet housing 11. Flanges 71 form a sleeve into which slides wall mounting bracket 67, thereby mating flanges 73 snugly under flanges 71. Thus when mounting bracket 67 is mounted to shower stall side wall 2*a* or 2*b*, ratchet housing 11 may then be fitted onto mounting bracket 67 when installing retractable shower screen 1.

Figure 7:
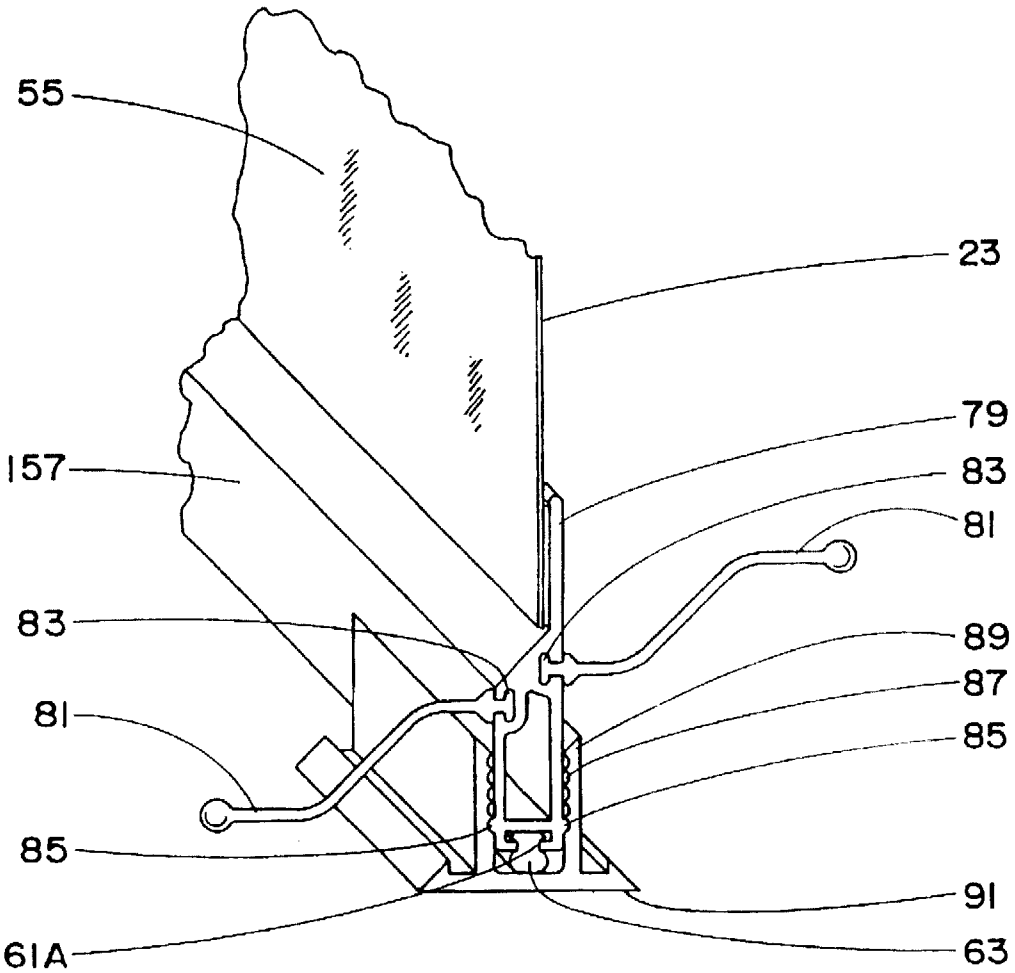
FIG. 7 is a perspective partial cut-away view of an alternative embodiment of the retractable shower screen of the present invention.
Figure 13:
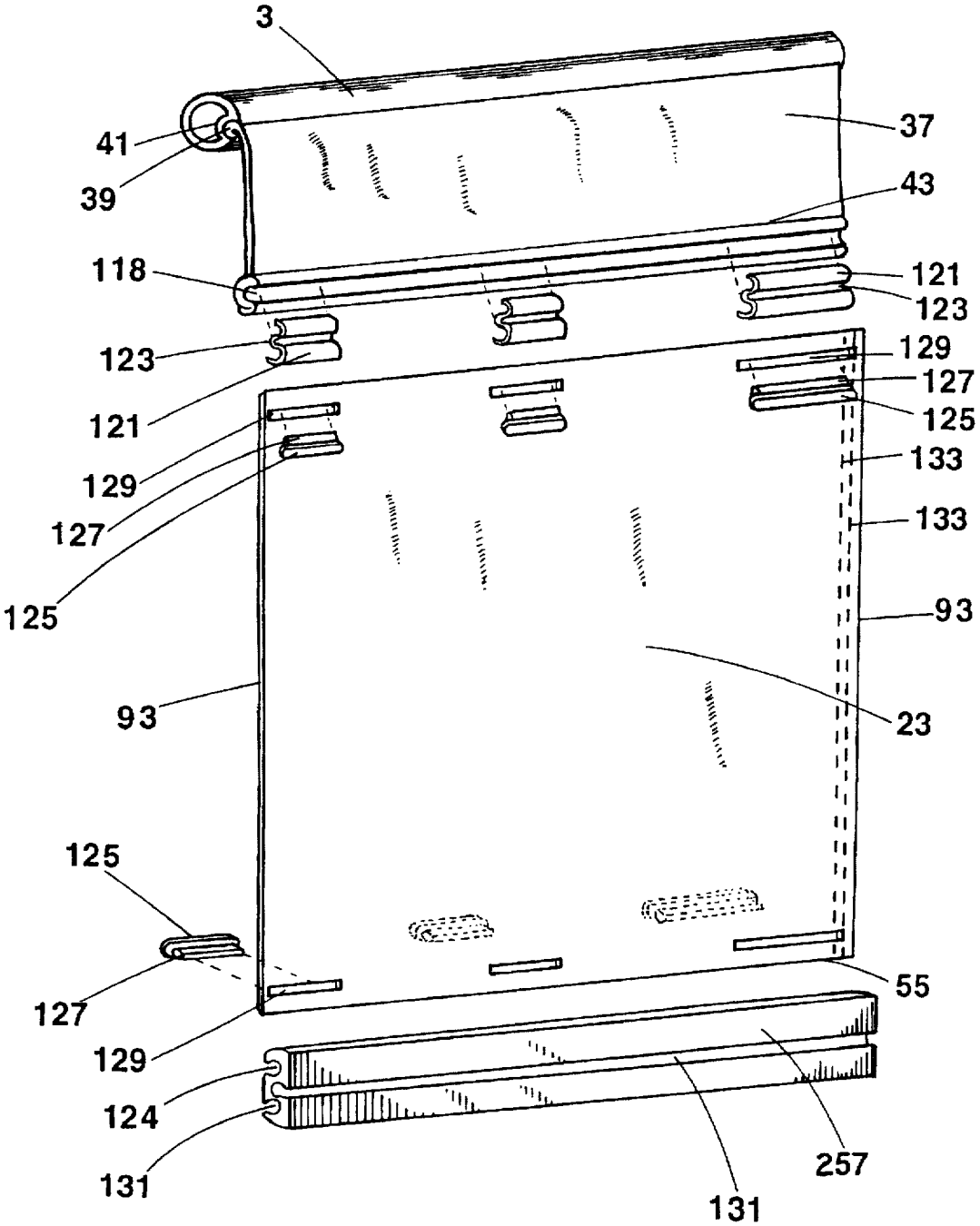
FIG. 13 is, in exploded perspective view, an alternative embodiment of a screen fastening means.
Figure 20:
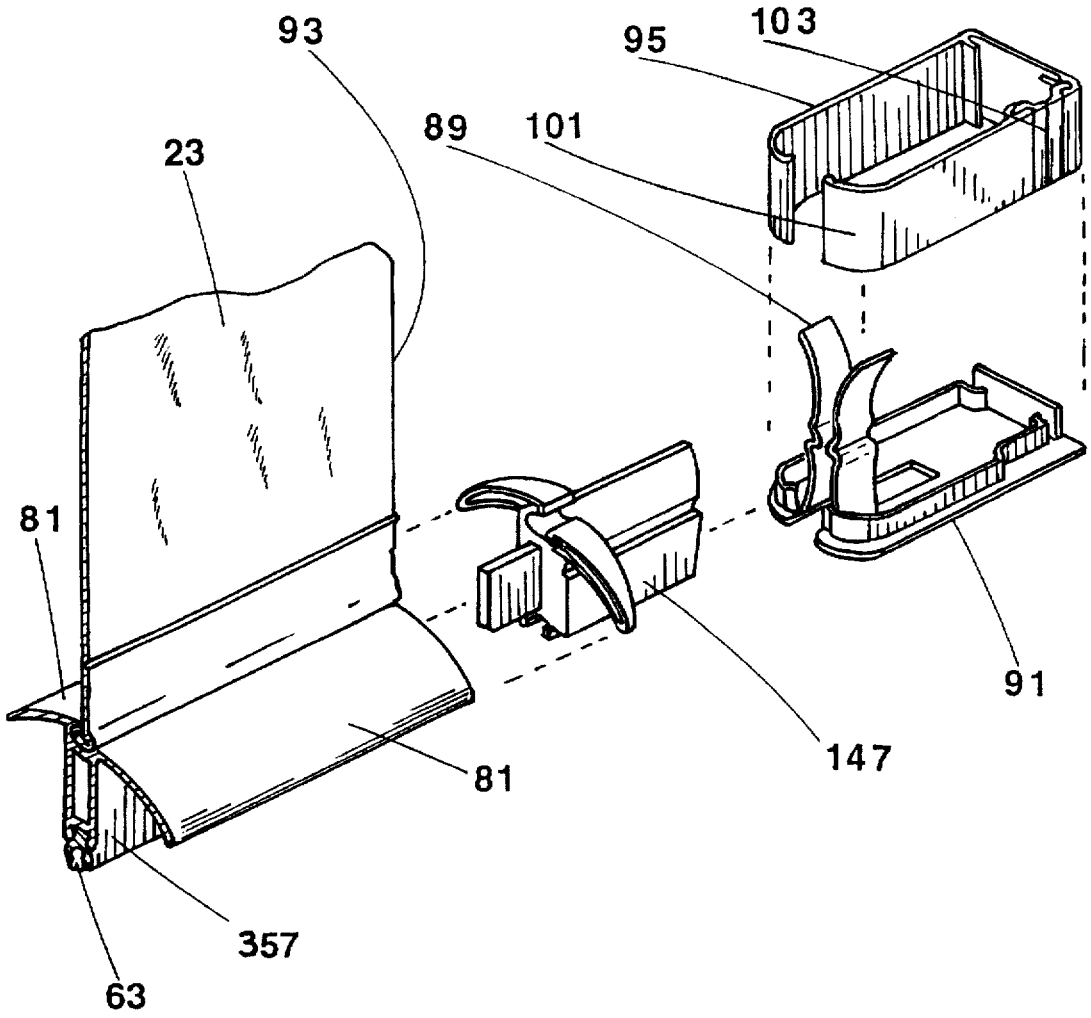
FIG. 20 is an exploded perspective cutaway view of the wall rail, wall rail base, and seal bar of the retractable shower screen of the present invention.
Figure 22:
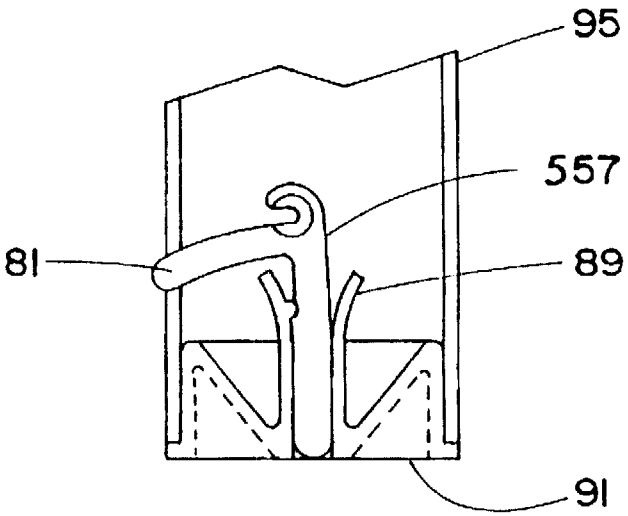
FIG. 22 is a cross-sectional view of a further alternative embodiment seal bar.
Figure 21:
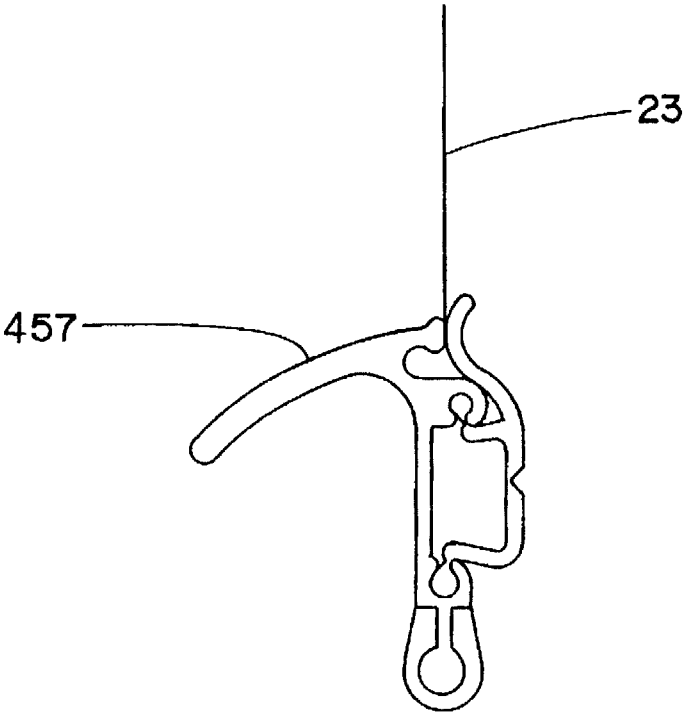
FIG. 21 is a cross-sectional view of an alternative embodiment seal bar.

As set out above, seal bar 57 may have other embodiments such as those depicted in FIGS. 7, 20–22. As depicted in FIG. 7, 13 seal bar 157 has upper flange 79 to which is affixed Velcro™ strip fasteners or like releasable fasteners for detachably fastening lower edge 55 of screen 23 to upper flange 79. Handles 81 are provided, mating in slots 83 in seal bar 157. Handles 81 may be used to lower and guide seal bar 157 when unrolling screen 23. Seal 63 is mounted in sliding fit in channel 61A. Seal bar 157 has protrusions 85 which matingly engage inner scalloped surface 87 on flanges 89. Flanges 89 are mounted to a base so as to Form a complete seal bar locking mechanism 91 mountable to the sill of a shower basin or the like (see FIGS. 7, 20, 22, 23). Seal bar 257 as depicted in FIG. 13 has grooves 131 into which may be mounted handles, such as handles 57*a* or 81. As seen in FIG. 20, alternative seal bar 357 may have handle end cap 147, shaped so as to releaseably mate, for example, between flanges 89 in the form of spring clips.

Figure 23:
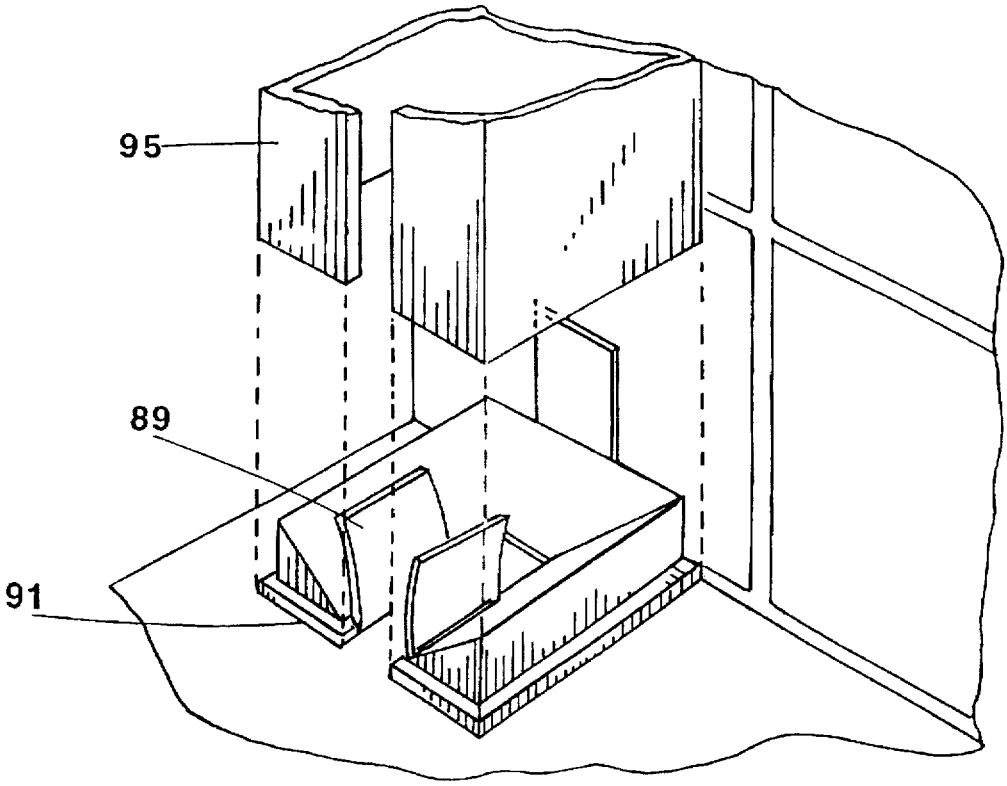
FIG. 23 is, in perspective view, an alternative embodiment wall rail base.

As shown in FIG. 23, seal bar locking mechanism 91 may be mounted, one at each end, in the comer formed between the edge or sill of shower stall catch basin 2*c*, and the shower stall side walls 2*a* and 2*b*. Locking mechanisms 91 hold the seal bars 57 firmly engaged against the edge or sill of catch basin 2*c* so that the egress of water under the seal bars is inhibited by seal 63.

A further embodiment, not shown, of seal bar locking mechanism 91 replaces protrusions 85 and mating scalloped surface 87 with a magnetic locking system whereby mating magnets would be respectively mounted, one facing upwards from the base of locking mechanism 91 and the corresponding magnet on the seal bar mounted facing downwards adjacent the end of seal 63.

Figure 8:
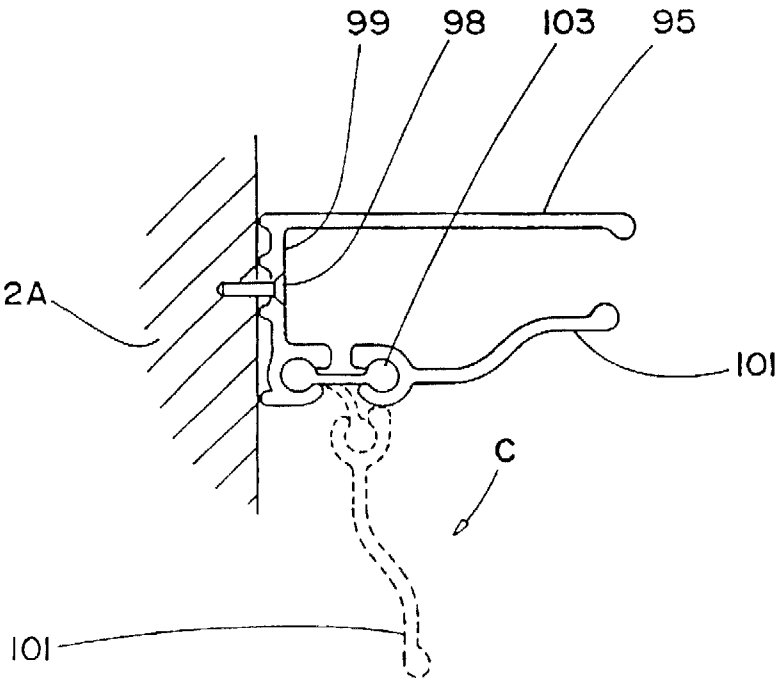
FIG. 8 is, in plan view, a shower screen rail for use in co-operation with the retractable shower screen of the present invention.

Shower screen 23 has vertical side edges 93. When screen 23 is deployed, that is, unrolled from shaft 3 so as to engage seal 63 with the edge or sill of catch basin 2*c*, edges 93 may be constrained within wall tracks 95 as depicted in FIG. 8 or moulded rails 2*d* as depicted in FIG. 1. Wall tracks 95 may be mounted to shower side walls 2*a* and 2*b* by screws 98 or tape or magnetic fasteners (not shown) between base 99 and wall 2*a*. Wall track 95 may have hinged flange 101 pivotally mounted to base 99, for example by flexible strip 103. Wall track 95 defines a sufficiently large channel so that when mounted vertically on wall 2*a* or 2*b*, the ends of the seal bar (or handle end caps 147) may travel vertically within wall track 95. With screen 23 deployed, wall track 95 provides an aesthetically appealing valance covering edges 93.

When it is desired to remove the seal bar from screen 23, for example when it is desired to remove screen 23 for cleaning, hinged flange 101 is rotated about hinge 103 in direction C to facilitate removal.

Figure 9:
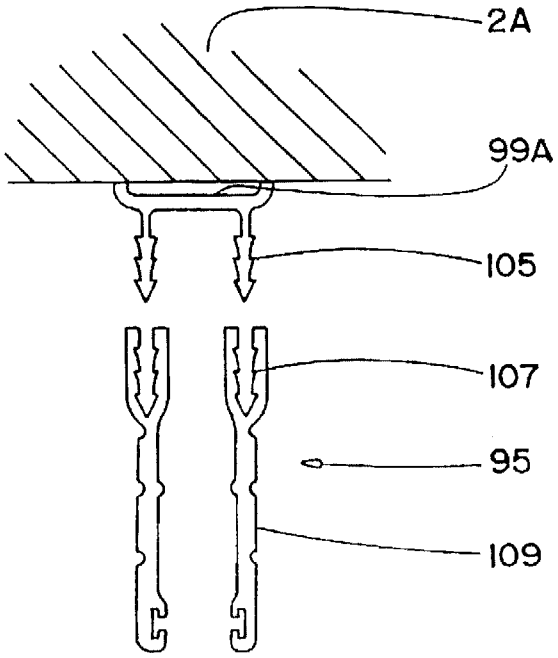
FIG. 9 is, in plan view, an alternative embodiment of a shower screen rail.

An alternative embodiment of wall track 95 is illustrated in FIG. 9. Base 99A has barbed rails 105. Barbed rails 105 mate in corresponding contoured grooves 107 in wall track flanges 109.

Figure 10:
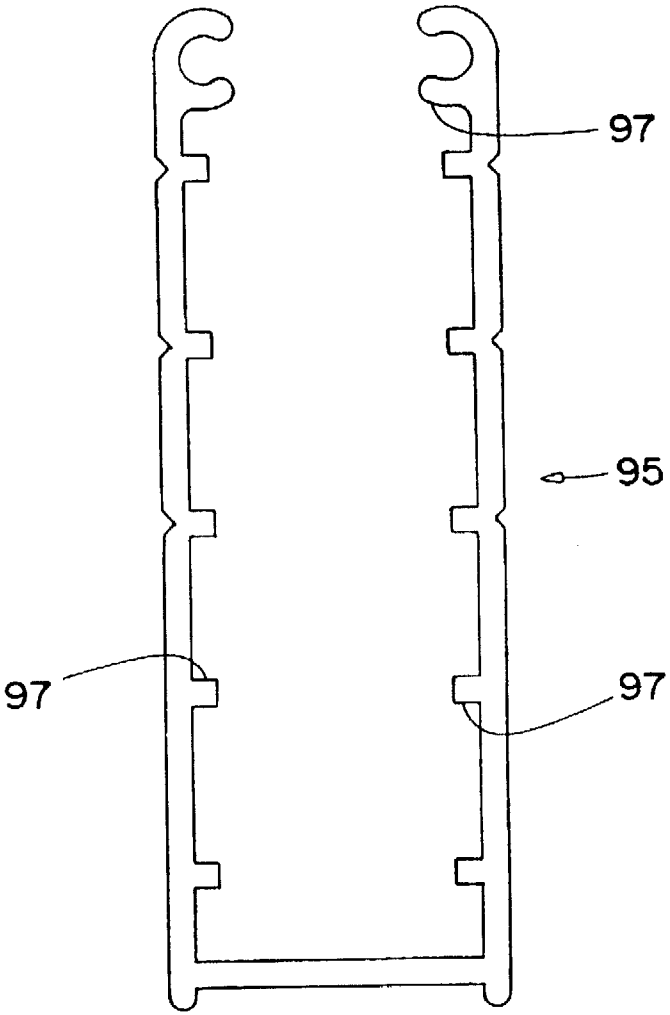
FIG. 10 is, in plan view, a further alternative embodiment of a shower screen rail.

A further alternative embodiment of wall tracks 95 is illustrated in FIG. 10. In this embodiment wall track 95 is a unitary piece of extruded U-shaped channel, possibly made of aluminum or plastic. Baffles 97 serve to inhibit the egress of water around the edges of screen 23 when screen 23 is deployed and vertical side edges 93 are constrained within wall tracks 95.

Figure 11:
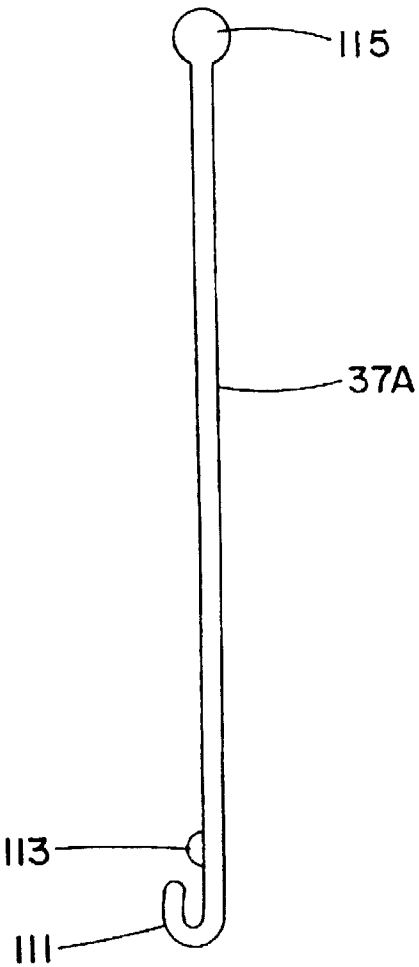
FIG. 11 is, in end-on elevation view, an alternative embodiment of a screen extension.

In an alternative embodiment of shower screen extension 37, shower screen extension 37 and upper coupling rail 47*a* are replaced by flexible strip 37A illustrated in end-on profile in FIG. 11. Hook 111 is shaped to mate with lower coupling rail 47*b* and protrusion 113 is provided on flexible strip 37A to releasably lock the upper edge of lower coupling rail 47*b* into engagement with hook 111. Flexible strip 37A has bulbous top edge 115 for a sliding snug fit in longitudinal roller groove 41.

Figure 15:
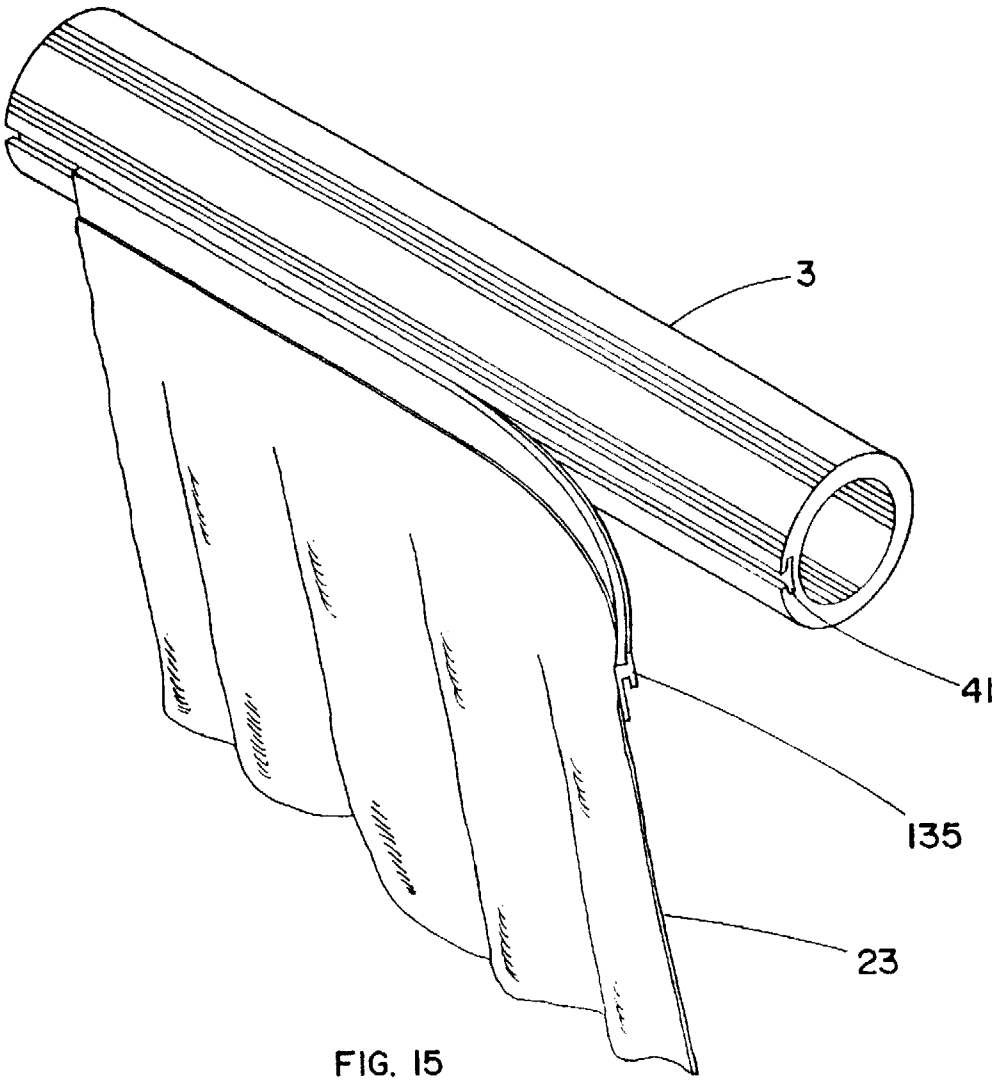
FIG. 15 is, in perspective view, an alternative embodiment of the retractable drawer screen of the present invention.
Figure 16:
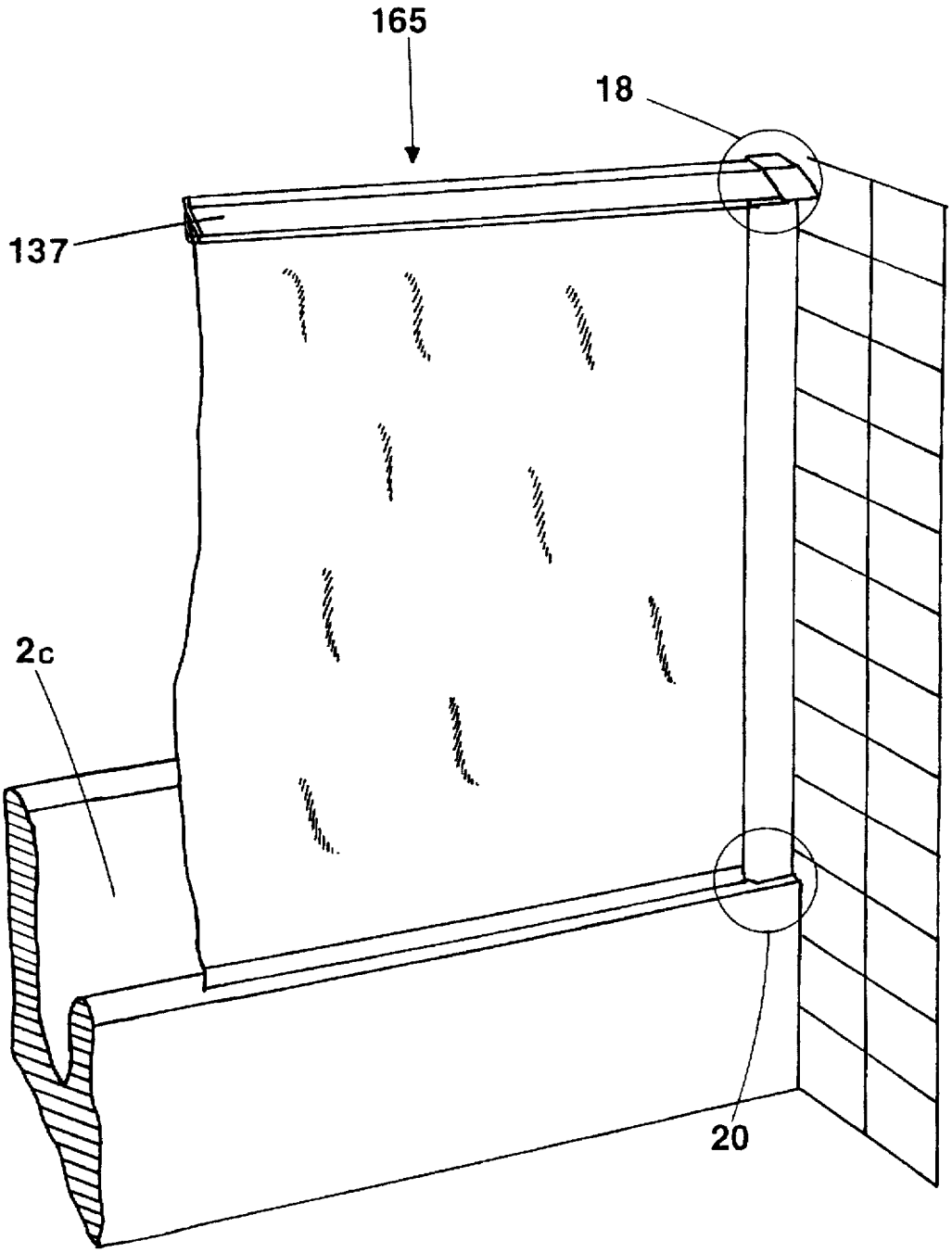
FIG. 16 is, in perspective view, an alternative embodiment of the retractable shower screen of FIG. 1.

It is understood that other means of releasably coupling screen extension 37 to screen 23 may be employed or that coupling screen extension 37 may be omitted entirely and screen 23 mountable directly onto roller 3 (as shown in FIG. 15). For example, as illustrated in FIG. 13, shower screen extension 37 may be a flexible strip having a long edge 43 and a channel 118. Channel 118 may be formed as part of screen extension 37. Rigid clips 121, which may he made of PVC and the like, mate snugly in channel 118. In particular, rigid channel 123 snaps into flexible channel 118 and are held firmly in place. In the embodiment illustrated in FIG. 15, screen 23 has resilient strip 135 which may as illustrated from a "T" in cross-section, attached to screen 23 by sewing, heat welding, adhesive or the like, which removably mates in longitudinal roller groove 41 which may be correspondingly "T" in frictional engagement therein, for example by means of a ZIPLOCK (TM) type closure.

Pegs 125 releasably secure edge 45 of screen 23 against the clips 121 mounted to screen extension 37 by a snug fit of peg ends 127 through openings 129 in screen 23 into mating engagement with rigid channels 123. Alternatively, instead of screen 23 having openings 129, peg ends 127 may be used to force a bite of screen 23 into channel 123 to thereby releasably fasten screen 23 to screen extension 37. A similar releasable fastening system may be used to releasably fasten edge 55 of screen 23 to the seal bar.

Also as illustrated in FIG. 13, screen 23 may have seams 133 formed along one or both side edges 93. Seams may be by way of stitching, gluing or heat sealing if screen 23 is made of vinyl or the like. Screen 23 may thus be trimmed to fit different sized shower stalls 2 by cutting along seams 133.

In an alternative embodiment, ratchet lever 13 is replaced with a mechanism which by means of opening roller housing door 137 thereby allows ratchet lever 139 to be forced into engagement with gear teeth 7 to control the unrolling of shower curtain 23 from roller shaft 3. In particular, as illustrated in FIGS. 16–19, opening door 137 in the manner shown in FIG. **19*b* engages ratchet lever 139 with gear teeth 7. Roller housing door 137 may be provided with wiper 141*a*. With roller homing door 137 closed, opposed wipers 141*a* and 141*b* act to trap screen 23 between their respective resilient wiper blades. Thus retracting screen 23 onto roller 3 wipes water from screen 23 by the squeegee action of wipers 141*a* and 141*b***.

The embodiment illustrated in FIG. 12 may, as shown in FIG. 18, include an inner extrusion 143. Roller housing living hinge 145 is provided to allow roller housing door 137 to be opened on roller housing 65. Inner extrusion 143 allows for sliding mating of retainer 151 (for retaining bearing plate 120) into roller housing 65.

Figure 24:
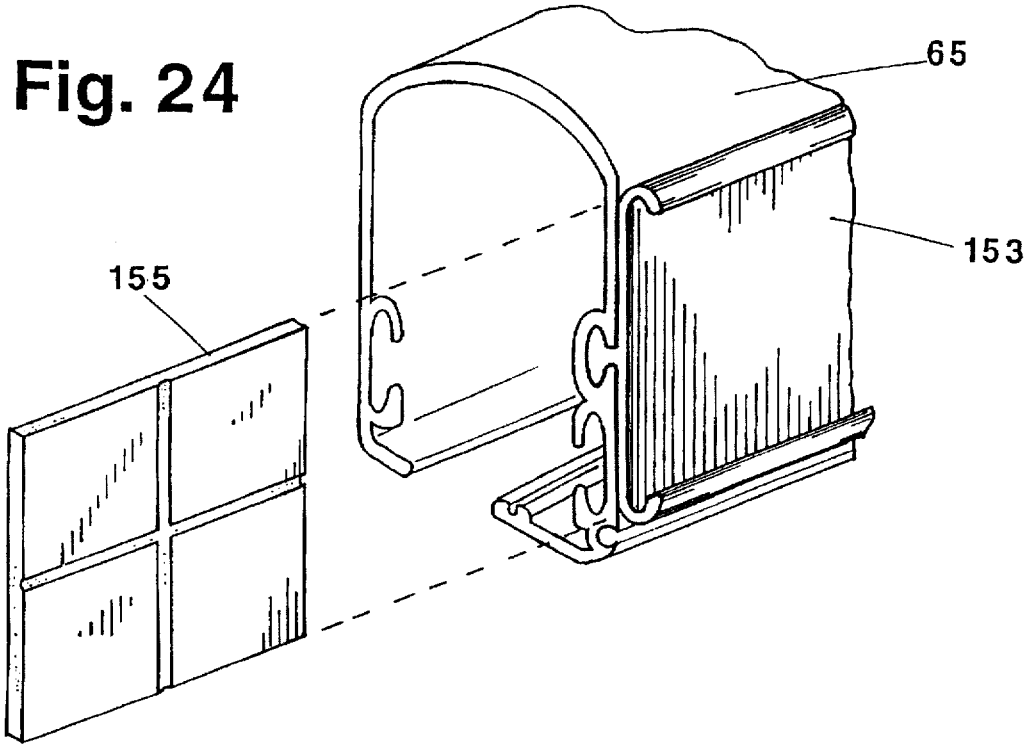
FIG. 24 is, in perspective view, an alternative embodiment roller housing.

In a further embodiment, as depicted in FIG. 24, roller housing 65 may have bracket 153 mountable longitudinally along the one or both sides. Bracket 153 serves to hold either decorative inserts 155 (simulated tile or the like) or strip light sources (not shown) for illuminating the shower stall, such light sources manufactured by, for example, Black & Decker under the trade mark Snake Lite.

It is to be understood that references to flexible strip 103 or living hinge 145, both pivot-type hinges, should also be taken to include cabinet or cylinder hinges known in the prior art, as, for example, cabinet hinges manufactured by Blum (TM) under the trade mark Blum Modul Hinges.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A roller mountable shower screen comprising an elongated spring-biased roller having first and second ends;

said roller having a biasing spring for spring assisted rotationally resilient rotation of said roller in a first rotational direction whereby said screen may be rolled onto said roller, said biasing spring adapted to allow reversed rotation of said roller in a second rotational direction opposed to said first rotational direction against a return resilient rotational biasing force of said biasing spring whereby said screen may be unrolled from said roller;

said shower screen detachably mountable to said roller along a first edge of said shower screen;

releasable ratcheting means co-operating with said first end of said roller for unidirectional unrolling in said second rotational direction of said shower screen from said roller in a first direction when said ratcheting means is engaged in ratcheting engagement with said roller whereby said shower screen is prevented from rolling back onto said roller;

said second end of said roller mountable in a support mountable to a shower stall surface for rotatably supporting said second end of said roller;

said ratcheting means further comprising ratchet releasing means for selectively disengaging said ratcheting means from said ratcheting engagement with said roller.

2. The device of claim 1 wherein said first edge of said shower screen is detachably mountable along substantially the length of said roller, said ratcheting means comprising a ratchet gear affixed to said first end of said roller and co-operating with a resiliently-biased mating dog.

3. The device of claim 2 wherein said sealing means comprises a bar having first and second longitudinal edges, said first longitudinal edge of said bar releasably attachable to a second edge of said shower screen opposed to said first edge, said second edge releasably attachable to a seal, wherein said seal comprises a strip of resilient material.

4. The device of claim 3 wherein said bar further comprises a longitudinal handle, said longitudinal handle comprising a flange extending outwardly from said bar whereby said flange may be grasped to lower in said first direction said shower screen from said roller.

5. The device of claim 4 wherein said ratcheting means is mountable between said first bracket and said first end of said roller.

6. The device of claim 5 further comprising an opposed pair of surface mountable guide channels for guiding between opposed shower stall surfaces, said bar and said shower screen within said guide channels when said guide channels are mounted to said opposed shower stall surfaces.

7. The device of claim 6 wherein said guide channels comprise front and rear longitudinal sidewalls extending substantially at right angles from said opposed shower stall surfaces when said guide channels are mounted to said shower stall surfaces, said front longitudinal side walls each rotatable about a longitudinal hinge, said longitudinal hinges adjacent to said shower stall surfaces when said guide channels are mounted to said shower stall surfaces.

8. The device of claim 7 further comprising a roller housing for covering said roller and said shower screen when said shower screen is rolled onto said roller, said roller housing extending longitudinally along the length of said roller and adapted at a first end of said roller housing to support said ratcheting means between said first bracket and said first end of said roller.

9. A retractable shower screen comprising:

(a) a spring-biased roller having first and second ends mountable within an elongate housing for mounting in a shower stall;

(b) first and second brackets, mountable to surfaces in said shower stall corresponding to said first and second ends, for releasable respective mating engagement of said first and second brackets with said first and second ends of said roller;

(c) first spring housing means for longitudinally biasing said first and second brackets in opposed directions against said surfaces in said shower stall;

(d) a flexible sheet having first and second longitudinal edges, said first longitudinal edge of said flexible sheet releasably attachable to said roller between said first and second ends;

(e) sealing means, releasably attachable to said second longitudinal edge of said flexible sheet, for sealing said second longitudinal edge of said flexible sheet to an opposed surface of said shower stall opposed to said surfaces in said shower stall corresponding to said first and second ends;

said spring-biased roller having second spring biasing means for rotationally resilient rotating of said roller, whereby said flexible sheet may be rolled onto and unrolled from said roller;

a ratchet co-operating with said roller, said ratchet releasably engageable whereby when engaged said flexible sheet may only be unrolled from said roller, said engaged ratchet preventing retraction of said flexible sheet onto said roller; whereby when said ratchet is engaged said flexible sheet may be unrolled from said roller so as to expose within said housing said first longitudinal edge of said flexible sheet, said flexible sheet then detachable from said roller.

10. The device of claim 9 wherein said roller has a longitudinal groove adapted to frictionally receive therein said first longitudinal edge of said flexible sheet and said first longitudinal edge comprises a male frictional mating means adapted to releasably frictionally engage said longitudinal groove in said roller.

11. The device of claim 10 wherein said longitudinal groove and said male frictional mating means are generally "T"-shaped in lateral cross-section and are correspondingly sized for snug releasable mating of said male frictional mating means in said longitudinal groove.

12. The device of claim 11 wherein said longitudinal groove is elongate and said male frictional mating means is elongate so as to extend longitudinally along substantially the length of said roller when releasably mated into said longitudinal groove.

13. The device of claim 9 wherein said first longitudinal edge of said flexible sheet is detachably mountable along substantially the length of said roller, said ratchet comprising a ratchet gear affixed to said first end of said roller and co-operating with a resiliently-biased mating dog.

14. The device of claim 13 wherein said sealing means comprises a bar having first and second longitudinal edges, said first longitudinal edge of said bar releasably attachable to said second longitudinal edge of said flexible sheet, said second longitudinal edge releasably attachable to a seal, wherein said seal comprises a strip of resilient material.

15. The device of claim 14 wherein said bar further comprises a longitudinal handle, said longitudinal handle comprising a flange extending outwardly from said bar whereby said flange may be grasped to unroll said flexible sheet from said roller.

16. The device of claim 15 wherein said ratchet is mountable between said first bracket and said first end of said roller.

17. The device of claim 16 further comprising an opposed pair of surface mountable guide channels for guiding between said opposed surfaces, said bar and said flexible sheet within said guide channels when said guide channels are mounted to said opposed surfaces.

18. The device of claim 17 wherein said guide channels comprise front and rear longitudinal sidewalls extending substantially at right angles from said surfaces in said shower stall when said guide channels are mounted to said surfaces in said shower stall, said front longitudinal side walls each rotatable about a longitudinal hinge, said longitudinal hinges adjacent to said surfaces on said shower stall when said guide channels are mounted to said surfaces in said shower stall.

19. The device of claim 18 further comprising a roller housing for covering said roller and said flexible sheet when said flexible sheet is rolled onto said roller, said roller housing extending longitudinally along the length of said roller and adapted at a first end of said roller housing to support said ratchet between said first bracket and said first end of said roller.

20. The device of claim 9 wherein said flexible sheet comprises trimming seams formed in said flexible sheet in parallel spaced apart array parallel to at least one edge of said flexible sheet so as to allow trimming of strips of flexible sheet material from said at least one edge of said flexible sheet whereby said flexible sheet may be sized to accommodate different sized shower stalls.

21. The device of claim 1 wherein said roller has a longitudinal groove adapted to frictionally receive therein said first edge of said shower screen and said first edge comprises a male frictional mating means adapted to releasably frictionally engage said longitudinal groove in said roller.

22. The device of claim 21 wherein said longitudinal groove and said male frictional mating means are generally "T"-shaped in lateral cross-section and are correspondingly sized for snug releasable mating of said male frictional mating means in said longitudinal groove.

23. The device of claim 22 wherein said longitudinal groove is elongate and said male frictional mating means is elongate so as to extend longitudinally along substantially the length of said roller when releasably mated into said longitudinal groove.

24. The device of claim 1 wherein said shower screen comprises trimming seams formed in said shower screen in parallel spaced apart array parallel to at least one edge of said shower screen so as to allow trimming of strips of shower screen material from said at least one edge of said shower screen whereby said shower screen may be sized to accommodate different sized shower stalls.

* * * * *